US006615778B2

(12) United States Patent
Iwaki et al.

(10) Patent No.: US 6,615,778 B2
(45) Date of Patent: Sep. 9, 2003

(54) APPARATUS AND METHOD FOR DIAGNOSING VARIABLE VALVE TIMING APPARATUS

(75) Inventors: Haruhiro Iwaki, Atsugi (JP); Hajime Hosoya, Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 0 days.

(21) Appl. No.: 09/989,380

(22) Filed: Nov. 21, 2001

(65) Prior Publication Data

US 2002/0062798 A1 May 30, 2002

(30) Foreign Application Priority Data

Nov. 27, 2000 (JP) ..... 2000-360057

(51) Int. Cl.[7] ..... F01L 1/34

(52) U.S. Cl. ..... 123/90.17; 123/90.15; 123/90.31; 251/12; 464/160

(58) Field of Search ..... 123/90.15, 90.16, 123/90.17, 90.18, 90.31; 464/1, 2, 160; 251/12, 251

(56) References Cited

U.S. PATENT DOCUMENTS 5,184,578 A * 2/1993 Quinn et al. ..... 123/90.17
5,529,034 A * 6/1996 Sone et al. ..... 123/90.17
5,537,961 A * 7/1996 Shigeru et al. ..... 123/90.15
5,937,808 A * 8/1999 Kako et al. ..... 123/90.15
5,979,378 A * 11/1999 Matsuno et al. ..... 123/90.15
6,032,623 A * 3/2000 Yamagishi et al. ..... 123/90.15
6,094,974 A * 8/2000 Yamagishi et al. ..... 73/117.3
6,257,184 B1 * 7/2001 Yamagishi et al. ..... 123/90.15
6,330,870 B1 * 12/2001 Inoue et al. ..... 123/90.17
6,390,044 B2 * 5/2002 Yoshizawa et al. ..... 123/90.17

FOREIGN PATENT DOCUMENTS

DE 10054101 A1 * 6/2001 ..... G05B/11/00
JP 10-153104 6/1998
JP 2000-054870 2/2000

* cited by examiner

*Primary Examiner*—Thomas Denion
*Assistant Examiner*—Ching Chang
(74) *Attorney, Agent, or Firm*—Sughrue Mion, PLLC

(57) ABSTRACT

In a variable valve timing apparatus for variably controlling the valve timing by changing a rotation phase of a camshaft with respect to a crankshaft, an abnormality diagnosis of the apparatus is performed on a condition that a change amount per unit time in a control target value of the rotation phase has been kept equal to or less than a predetermined limit value for a predetermined period or more.

14 Claims, 6 Drawing Sheets

APPARATUS AND METHOD FOR DIAGNOSING VARIABLE VALVE TIMING APPARATUS

FIELD OF THE INVENTION

The present invention relates to an apparatus and a method for diagnosing an abnormality in a variable valve timing apparatus for an internal combustion engine.

RELATED ART OF THE INVENTION

There has been known a conventional variable valve timing apparatus for an engine, for changing a rotation phase of a camshaft relative to a crankshaft by controlling a rotation delay of the camshaft relative to the crankshaft based on a friction braking by an electromagnetic brake (Japanese Unexamined Patent Publication 10-153104).

In this variable valve timing apparatus, for example, a basic control amount of the electromagnetic brake is calculated based on a target rotation phase (target rotation delay) and an engine rotation speed, while calculating a feedback control amount from a deviation between the target rotation phase and an actual rotation phase. Then, a final control amount (for example, duty control amount) is determined from the basic control amount and the feedback control amount, to control a current flowing in an electromagnetic coil constituting the electromagnetic brake.

As a variable valve timing apparatus for an internal combustion engine, in general, a hydraulic type apparatus other than the above type is known.

An abnormality diagnosis of such a variable valve timing apparatus (VTC) has been on condition that a target value (hereinafter, target angle) of the rotation phase of the camshaft relative to the crankshaft continues to be held constant for a predetermined period or more (Japanese Unexamined Patent Publication 2000-54870).

In the above variable valve timing apparatus (VTC), since an engine operating region for each target angle is set a relatively large, an opportunity to establish the abnormality diagnosis condition can be secured enough. However, in particular, in the above mentioned electromagnetic brake type apparatus, since the target angle is set fine for each narrow engine operating region, it is hard to sufficiently secure the opportunity to establish the abnormality diagnosis condition, leading a possibility that the diagnosis is not completed.

SUMMARY OF THE INVENTION

The present invention has been achieved in view of the foregoing problem, and has an object of securing an opportunity to establish an abnormality diagnosis condition and completing a diagnosis even in a case a target angle is set fine.

To achieve the above object, with the present invention, in a variable valve timing apparatus constituted to change the valve timing by changing a rotation phase of a camshaft relative to a crankshaft, an abnormality diagnosis in this apparatus is performed on condition that a change amount per unit time of a control target value of the rotation phase continues to be held at a predetermined limit value or less for a predetermined period.

Accordingly, even in case the control target value (target angle) of the rotation phase is set fine to be changed by a slight change of an engine operating condition, a diagnosis execution is permitted on condition that the change amount per unit time continues to be held at the limit value or less for the predetermined period.

Therefore, diagnosis opportunity is sufficiently secured and the diagnosis can be completed.

The other objects and features of this invention will become understood from the following description with accompanying drawings.

EMBODIMENT

An embodiment according to the invention will be explained as follows.

Figure 1:
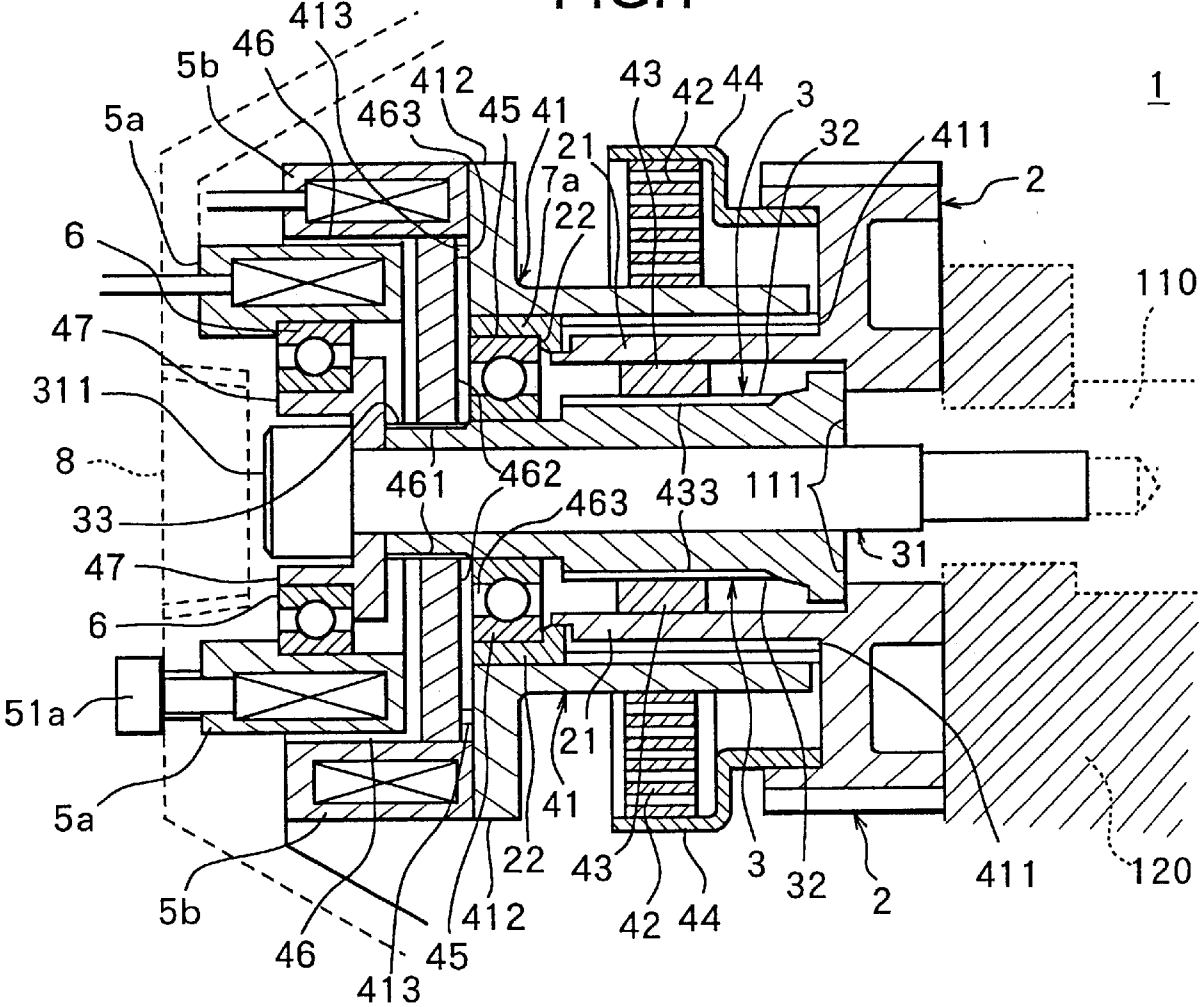
FIG. 1 is a sectional view of a variable valve timing apparatus according to an embodiment.
Figure 2:
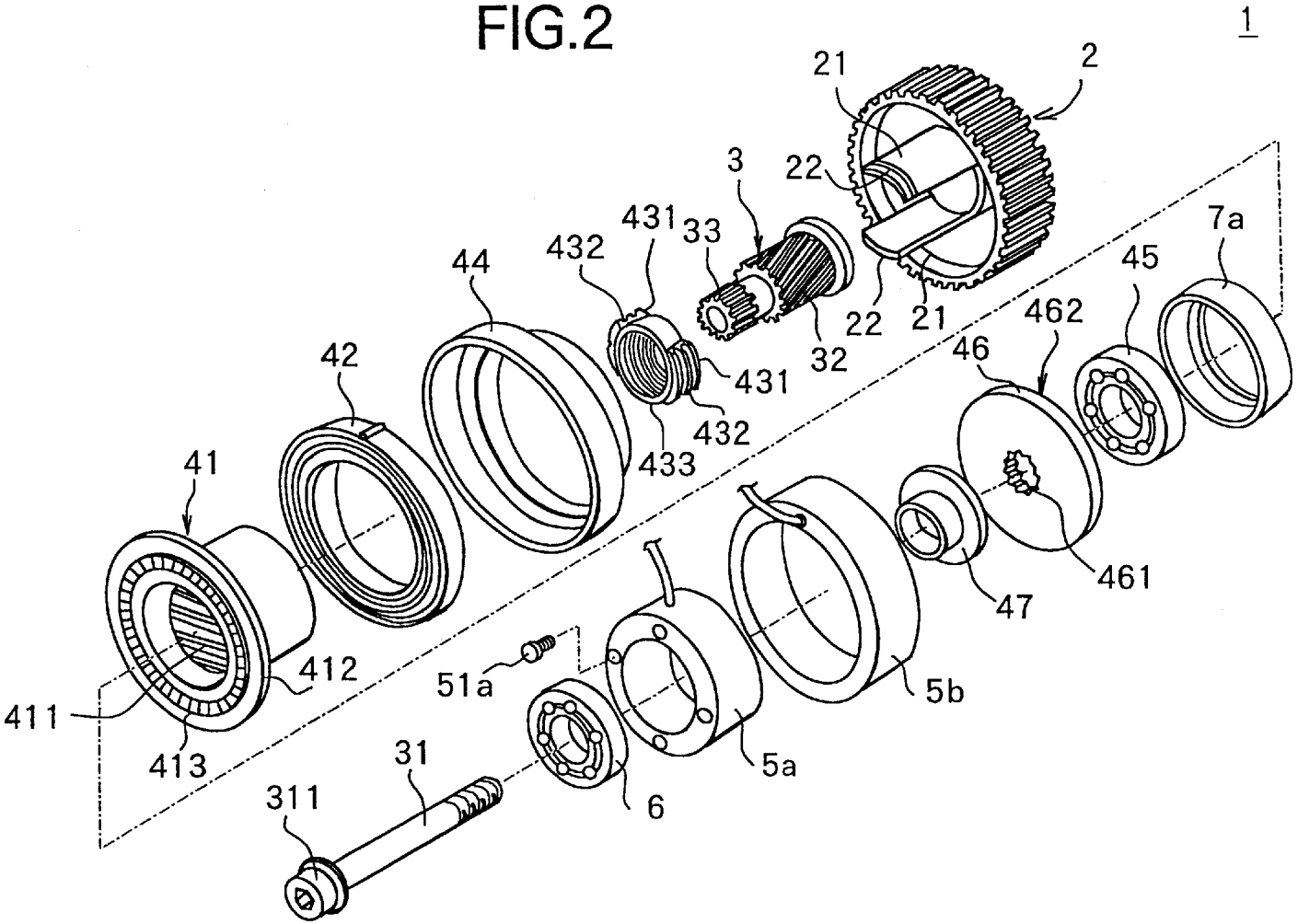
FIG. 2 is an exploded perspective view of the variable valve timing apparatus according to the embodiment.

FIG. 1 is a sectional view of a variable valve timing apparatus using an electromagnetic brake in the embodiment and FIG. 2 is an exploded perspective view thereof.

In variable valve timing apparatus 1 shown in FIG. 1 and FIG. 2, a pulley 2 (or sprocket) is rotatably supported around an axis of an end portion 111 of a camshaft 110 rotatably supported to a cylinder head 120. Pulley 2 is supported to camshaft 110 in a relative rotatable manner, and is rotated in synchronization with the rotation of a crankshaft of an engine.

On an extending line of end portion 111 of camshaft 110 is fixed a transmission member 3 with a gear being formed around an axis thereof, by a bolt 31 and the rotation of pulley 2 is transmitted to transmission member 3 through a transmission mechanism to be described later.

A cylindrical drum 41 with a flange is disposed on the same axis as camshaft 110, and between drum 41 and pulley 2 is disposed a coil spring 42 for urging a rotation phase of drum 41 to advance. That is, a case member 44 is fixed to pulley 2 and an outer peripheral end of coil spring 42 is fixed to an inner peripheral surface portion of case member 44 and an inner peripheral end of coil spring 42 is fixed to an outer peripheral surface of drum 41.

A gear 32 formed around the axis of transmission member 3 is in mesh with a gear 433 formed on an inner periphery of a cylindrical piston member 43 by a helical mechanism with a helical gear.

Engagement portions 431, 431 are projectingly formed on opposite two portions of an outer peripheral surface of piston member 43, to be engaged between pawl members 21, 21 extending in an axial direction of camshaft 110 from a rotation center portion of pulley 2. Piston member 43 and pulley 2 are rotated on the same phase by this engagement.

Engagement portions 431, 431 of piston member 43 are formed with male screws 432 as a center thereof being an axis of piston member 43, respectively, to be engaged with female screws 411 formed on an inner peripheral surface of drum 41 by a screw function.

A drum bearing member 45 is disposed between an outer periphery of transmission member 3 and an inner periphery of drum 41, to bear the relative rotation of them. A pawl receiving member 7*a* is disposed between drum bearing member 45 and the inner peripheral surface of drum 41.

Pawl receiving member 7*a* is supported by the inner peripheral surface of drum 41 and contacts step portions 22, 22 formed on outer peripheral surfaces of tip end portions of pawl members 21, 21 to retain pawl members 21, 21 in a radial direction of camshaft 110.

A sucked member 46 is formed with an internal spur gear 461 at a rotation center thereof and the gear 461 is engaged with a spur gear 33 formed on a tip end portion of transmission member 3. Thereby, sucked member 46 is constituted to be slidable to transmission member 3 in an axial direction of transmission member 3 and also rotatable on the same phase as transmission member 3.

A gear 413 is formed on a side surface of a flange portion 412 of drum 41 to face a gear 463 formed on one surface 462 of sucked member 46. As a result, both of these gears are in mesh to engage drum 41 and sucked member 46 in the rotation direction.

A first electromagnetic solenoid 5*b* and a second electromagnetic solenoid 5*a*are positioned through a bearing member 6 so as to surround an axis line of camshaft 110, and also to surround transmission member 3 fixed to the end portion 111 of camshaft 110, and an outer peripheral surface of bolt 31 fixing transmission member 3.

A spacer member 47 is inserted fixedly between a head portion 311 of bolt 31 and the tip end portion of transmission member 3 and, on an outer peripheral surface side of spacer member 47, second electromagnetic solenoid 5*a* is disposed through bearing member 6. Further, first electromagnetic solenoid 5*b* constituting an electromagnetic brake is disposed between second electromagnetic solenoid 5*a* and an outer peripheral surface of sucked member 46. Second electromagnetic solenoid 5*a* is fixed to a case 8 by a bolt 51*a*.

An operation of the embodiment will be explained as follows.

In order to change a rotation phase of camshaft 110 into an advance side, piston member 43 is moved to the axial direction of camshaft 110 by a magnetic field generated by first electromagnetic solenoid 5*b*.

Namely, First of all, when sucked member 46 is sucked by the magnetic field generated by second electromagnetic solenoid 5*a*, gear 463 of sucked member 46 and gear 413 of drum 41 are separated from each other, so that drum 41 can be relatively rotated to pulley 2.

Then, drum 41 is sucked by the magnetic field generated by first electromagnetic solenoid 5*b* to be pushed against an end face of first electromagnetic solenoid 5*b*, thereby performing a friction braking. Accordingly, drum 41 is subjected to a relative rotation due to a rotation delay to pulley 2 against an urging force of coil spring 42, and piston member 43 in mesh by screw 411 and screw 432 is moved to the axial direction of camshaft 110. Since piston member 43 and transmission member 3 are engaged by the helical mechanism, the rotation phase of transmission member 3, as well as camshaft 110 is changed to the advance side to pulley 2 by the movement of piston member 43. As a result, as a current value to first electromagnetic solenoid 5*b* is increased and a braking force (slide friction) against the urging force of coil spring 42 is increased, the rotation phase of camshaft 110 is changed further to the advance side of camshaft 110.

As described above, since the rotation phase of camshaft 110 is changed to pulley 2 (crankshaft) depending on a rotation delay amount of drum 41 determined corresponding to the braking force by the electromagnetic brake and the braking force of the electromagnetic brake is controlled by duty-controlling a current value supplied to first electromagnetic solenoid 5*b*, a change amount (advance amount) of the rotation phase can be continuously controlled by changing a duty ratio. The current value supplied to first electromagnetic solenoid 5*b* is increased in response to an increase in duty value (%) equivalent to a control amount of the electromagnetic brake.

Figure 3:
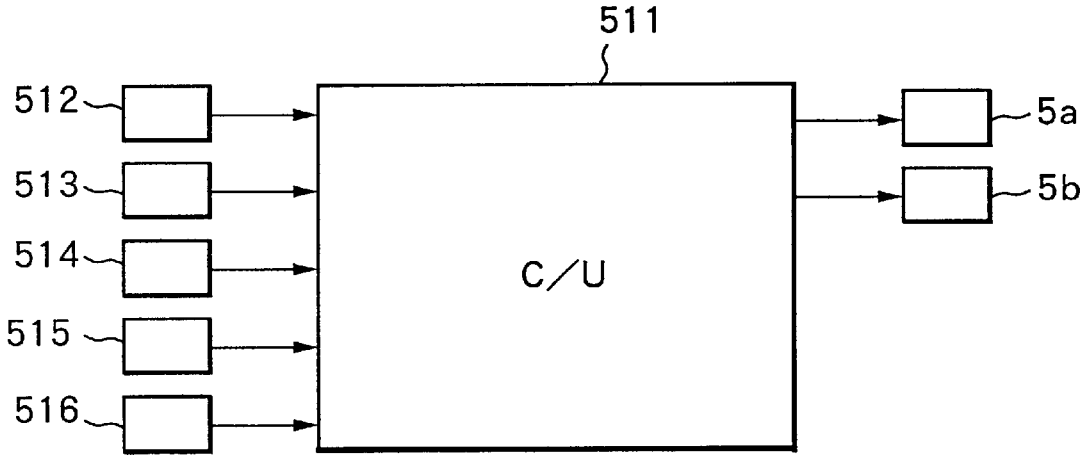
FIG. 3 is a block diagram of the variable valve timing apparatus according to the embodiment.

FIG. 3 is a block diagram showing a control system of the variable valve timing apparatus having the above constitution. A control unit 511 incorporating therein a microcomputer for controlling the power supply to first electromagnetic solenoid 5*b* and second electromagnetic solenoid 5*a*, is input with detections signals from an air flow meter 512 for detecting an engine intake air amount, a crank angle sensor 513 for detecting a crank rotation, a water temperature sensor 514 for detecting an engine cooling water temperature, an atmosphere temperature sensor 515 for detecting an atmosphere temperature, a cam sensor 516 for detecting a cam rotation and the like.

Control unit 511 duty-controls the power supply to first electromagnetic solenoid 5*b* to change the rotation phase of camshaft 110. When the rotation phase reaches a target rotation phase, gear 463 of sucked member 46 and gear 413 of drum 41 are engaged with each other by cutting off the power supply to second electromagnetic solenoid 5*a*, and drum 41 is fixed in a phase state at that time to pulley 2, to cut off the power supply to first electromagnetic solenoid 5*b*.

An abnormality diagnosis of the variable valve timing apparatus controlled in the above manner will be executed as follows.

Figure 4A:
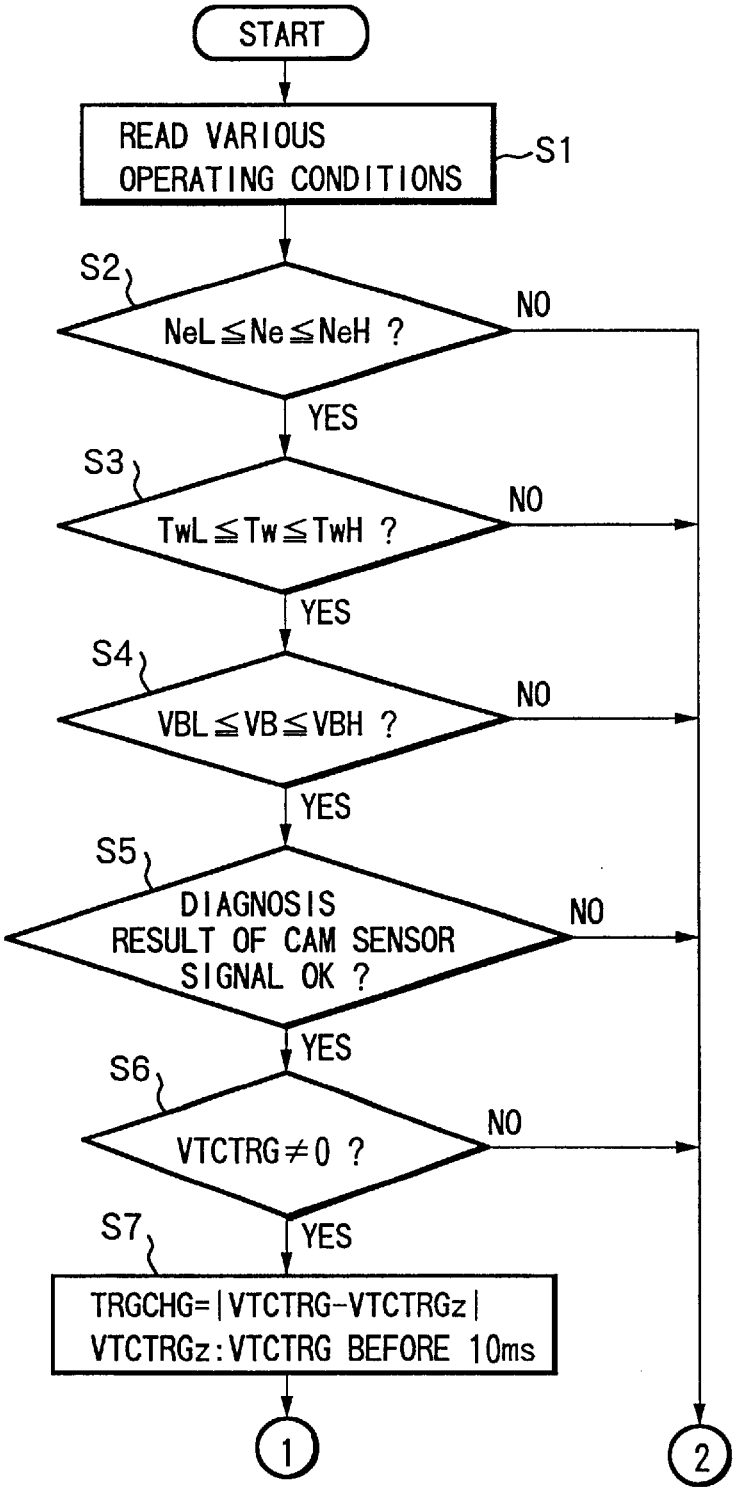
FIGS. 4A and 4B illustrate a flow chart showing a routine according to the invention for judging whether or not an abnormality diagnosis execution permission condition is established.
Figure 4B:
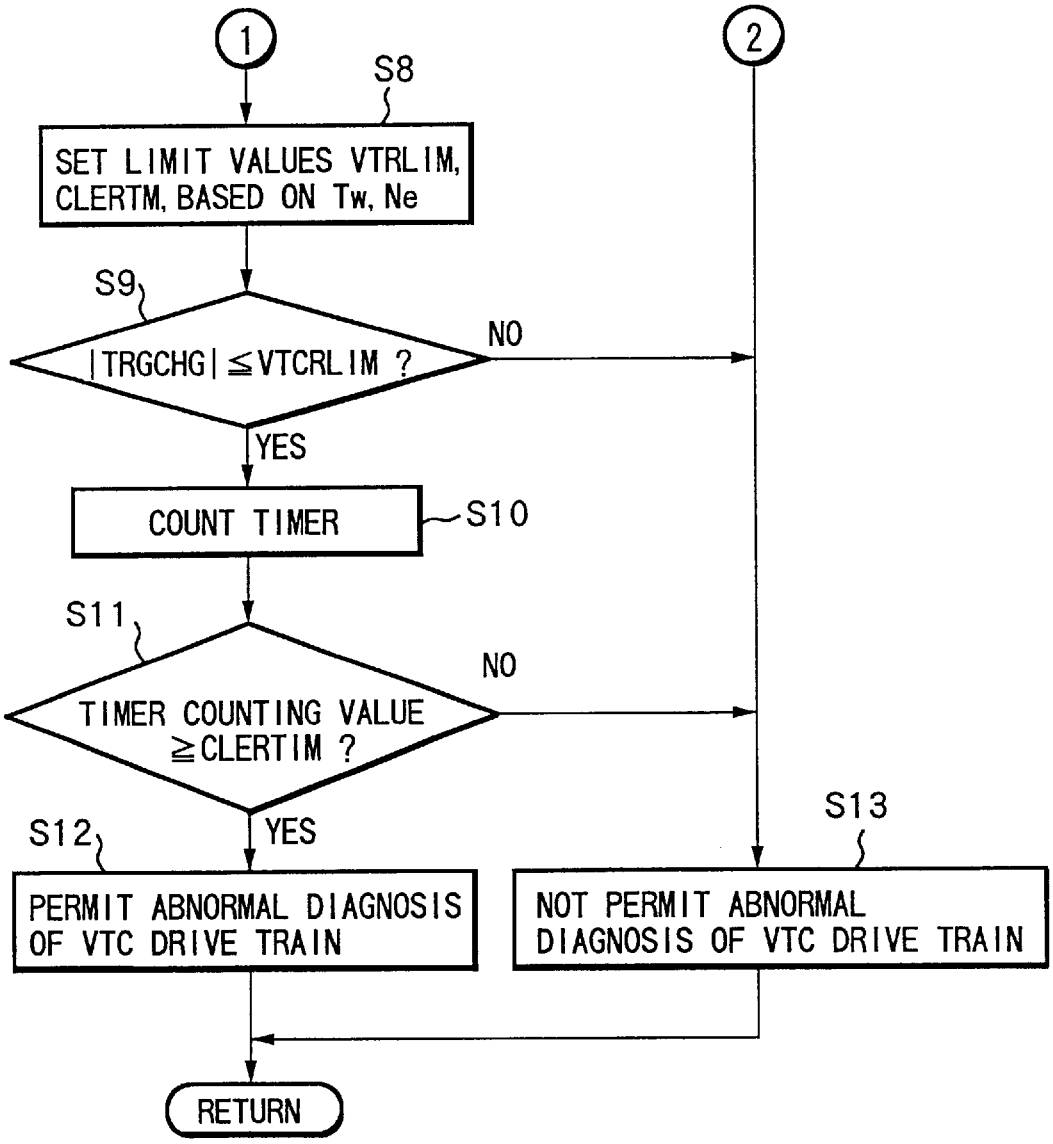

FIGS. 4A and 4B illustrate a flow chart of a routine according to the invention for judging whether or not an abnormality diagnosis execution permission condition is established.

In FIG. 4A at Step 1, various operating conditions detected from the respective sensors are read out.

At Step 2, it is judged whether or not an engine rotation speed Ne is within a predetermined range ($NeL \leq Ne \leq NeH$). When it is within the predetermined range, the control goes to Step 3.

At Step 3, it is judged whether or not an engine cooling water temperature (water temperature) Tw is within a predetermined range ($TwL \leq Tw \leq TwH$). When it is within the predetermined range, the control goes to Step 4.

At Step 4, it is judged whether or not a battery voltage VB is within a predetermined range ($VBL \leq VB \leq VBH$). When it is within the predetermined range, the control goes to Step 5.

At Step 5, it is judged whether or not a diagnosis result of signal of the cam sensor 516, such as disconnection or short-circuit, is OK. When it is OK, the control goes to Step 6.

At Step 6, it is judged whether or not a control target value, that is, a target angle VTCTRG is at a reference position regulated by a stopper, specifically at 0 (maximum retard position). When it is not at the reference position, the control goes to Step 8.

At Step 7, a change ratio TRGCHG of the target angle VTCTRG is calculated as follows.

$$TRGCHG=|VTCTRG-VTCTRGz|$$

VTCTRGz: target angle VTCTRG prior to 10 ms

At Step 8, a limit value VTRLIM being a threshold value of a diagnosis permission condition of the target angle change ratio TRGCHG is set based on the water temperature Tw and the engine rotation speed Ne.

At Step 9, it is judged whether or not an absolute value of the change ratio TRGCHG of the target angle VTCTRG calculated at Step 7 is equal to or less than the limit value VTRLIM. When it is equal to or less than the limit value VTRLIM, the control goes to Step 10 wherein a timer is counted up.

At Step 11, it is judged whether or not a timer count value reaches a predetermined value CLERTIM.

The execution of the abnormality diagnosis is not permitted at Step 13 until the timer count value reaches the predetermined value CLERTIM. When the timer count value reaches the predetermined value CLERTIM, that is, when the absolute value of the change ratio TRGCHG of the target angle VTCTRG has been kept equal to or less than the limit value VTRLIM for a predetermined period or more, the control goes to Step 12, wherein the execution of the abnormality diagnosis is permitted.

In this way, even if the target angle is set fine and is changed due to a slight change in the engine operating condition, the diagnosis is permitted to secure the diagnosis opportunity as long as the change ratio of the target angle is maintained equal to or less than the predetermined value for the predetermined period or more.

When the diagnosis permission condition is established, the abnormality diagnosis is executed.

Figure 5:
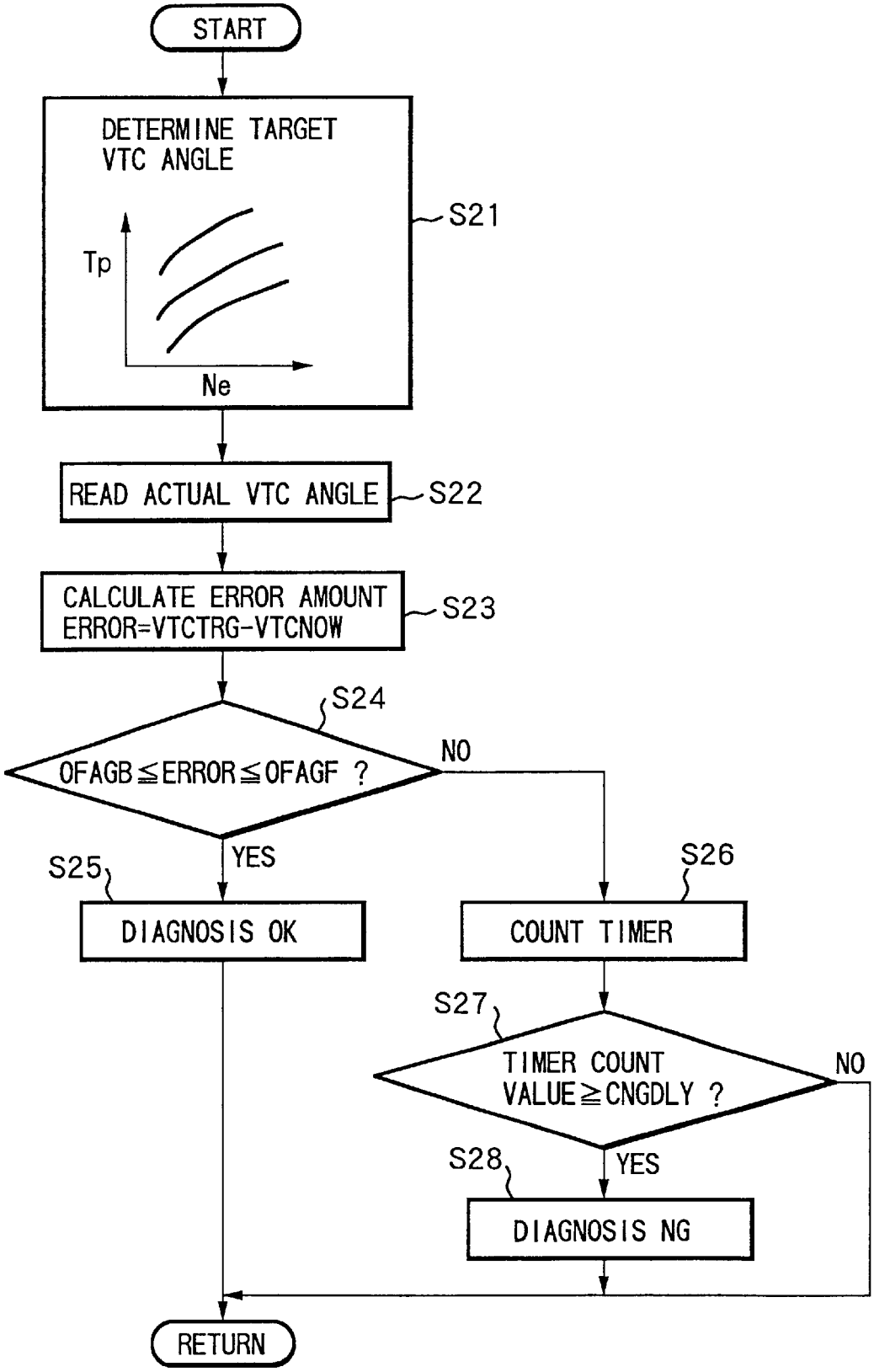
FIG. 5 is a flow chart of an abnormality diagnosis routine according to the embodiment.

FIG. 5 is a flow chart of an abnormality diagnosis routine.

In FIG. 5, at Step 21, the target angle VTCTRG set based on a basic fuel injection quantity Tp being a representative value of the engine rotation speed Ne and an engine load is read out.

At Step 22, an actual angle VTCNOW (actual rotation phase of the camshaft) is read out based on a signal of cam sensor 516.

At Step 23, a deviation ERROR (error amount) between the target angle VTCTGR and the actual angle VTCNOW is calculated as the following equation.

$$VTCTGR-VTCNOW$$

At Step 24, it is judged whether or not the deviation ERROR is within a predetermined range ($OFAGB \leq ERROR \leq OFAGF$).

When the deviation ERROR is within the predetermined range, the diagnosis result is judged as OK at Step 25 while when it is not within the predetermined range, the timer is counted up at Step 26. Then at Step 27, it is judged whether or not a count value reaches a predetermined value CNGDLY.

When the count value reaches the predetermined value CNGDLY, that is, when the deviation ERROR has been kept out of the predetermined range for a predetermined time or more, the control goes to Step 28 wherein the diagnosis result is judged as NG (presence of abnormality).

As a variable valve timing apparatus of electromagnetic brake type, there is an apparatus for performing a duty control by supplying a power to an electromagnetic brake all the time without provided with a locking mechanism by a second electromagnetic solenoid. The present invention can also be applied to the apparatus of such a constitution. The present invention can be applied to a hydraulic variable valve timing apparatus.

The entire contents of basic Japanese Patent Application No. 2000-360057 filed Nov. 27, 2000, a priority of which is claimed, are herein incorporated by reference.

What is claimed is:

1. An apparatus for diagnosing a variable valve timing apparatus comprising:

a variable valve timing apparatus which comprises, a camshaft for driving an intake valve and an exhaust valve of an internal combustion engine to be open/close, a valve timing adjustment mechanism for variably controlling a rotation phase of said camshaft with respect to a crankshaft, to adjust the valve timing of said intake valve and exhaust valve;

a change amount calculation unit for calculating a change amount per unit time in a control target value of said rotation phase;

a comparison unit for comparing said calculated change amount with a predetermined limit value;

a diagnosis permission unit for permitting an abnormality diagnosis of said variable valve timing apparatus on a condition that said change amount has been kept equal to or less than said predetermined limit value for a predetermined period by said comparison of said comparison unit; and a diagnosis unit for diagnosing an abnormality of said variable valve timing apparatus when said diagnosis permission unit permits said abnormality diagnosis.

2. An apparatus diagnosing a variable valve timing apparatus according to claim 1, wherein at least one of said predetermined limit value used in said comparison unit and said predetermined period used in said diagnosis permission unit is variably set corresponding to an engine temperature.

3. An apparatus diagnosing a variable valve timing apparatus according to claim 1, wherein at least one of said predetermined limit value used in said comparison unit and said predetermined period used in said diagnosis permission unit is variably set corresponding to an engine rotation speed.

4. An apparatus diagnosing a variable valve timing apparatus according to claim 1, wherein said diagnosis permission unit permits an abnormality diagnosis on a condition that an engine operating condition and an environment state satisfy predetermined conditions, in addition to the condition that the change amount has been kept equal to or less than said predetermined limit value for a predetermined period.

5. An apparatus diagnosing a variable valve timing apparatus according to claim 1, wherein said diagnosis permission unit also permits an abnormality diagnosis on a condition that the control target value of said rotation phase does not coincide with a reference value regulated by a stopper, in addition to the condition that the change amount has been kept equal to or less than said predetermined limit value for a predetermined period.

6. An apparatus diagnosing a variable valve timing apparatus according to claim 1, wherein said diagnosis unit judges an abnormality when a deviation between the control target value of said rotation phase and an actual value of said rotation phase has been kept out of a predetermined range for a predetermined period or more.

7. An apparatus diagnosing a variable valve timing apparatus according to claim 1, wherein said valve timing adjustment mechanism changes said rotation phase with respect to the crankshaft with a friction braking by an electromagnetic brake.

8. A method for diagnosing a variable valve timing apparatus which comprises a variable valve timing adjustment mechanism for variably controlling a rotation phase of a camshaft with respect to a crankshaft, to adjust the valve timing of an intake valve and an exhaust valve of an internal combustion engine, comprising:

calculating a change amount per unit time in a control target value of said rotation phase;

comparing said calculated change amount with a predetermined limit value;

permitting an abnormality diagnosis of said variable valve timing apparatus on a condition that said change amount has been kept equal to or less than said predetermined limit value for a predetermined period by said comparison; and diagnosing an abnormality of said variable valve timing apparatus when said abnormality diagnosis is permitted.

9. A method for diagnosing a variable valve timing apparatus according to claim 8, wherein at least one of said predetermined limit value and said predetermined period is variably set corresponding to an engine temperature.

10. A method for diagnosing a variable valve timing apparatus according to claim 8, wherein at least one of said predetermined limit value and said predetermined period is variably set corresponding to an engine rotation speed.

11. A method for diagnosing a variable valve timing apparatus according to claim 8, wherein an abnormality diagnosis is permitted on a condition that an engine operating condition and an environment state satisfy predetermined conditions, in addition to the condition that the change amount has been kept equal to or less than said predetermined limit value for a predetermined period.

12. A method for diagnosing a variable valve timing apparatus according to claim 8, wherein an abnormality diagnosis is permitted on a condition that the control target value of said rotation phase does not coincide with a reference value regulated by a stopper, in addition to the condition that the change amount has been kept equal to or less than said predetermined limit value for a predetermined period.

13. A method for diagnosing a variable valve timing apparatus according to claim 8, wherein the presence of abnormality is judged when a deviation between the control target value of said rotation phase and an actual value of said rotation phase has been kept out of a predetermined range for a predetermined period or more.

14. A method for diagnosing a variable valve timing apparatus according to claim 8, wherein the valve timing is controlled by changing said rotation phase with respect to the crankshaft with a friction braking by an electromagnetic brake.

* * * * *